US011371277B2

(12) United States Patent
Meyer

(10) Patent No.: US 11,371,277 B2
(45) Date of Patent: Jun. 28, 2022

(54) BIAXIAL TRACK SYSTEM FOR FENESTRATION PANELS

(71) Applicant: JELD-WEN, Inc., Charlotte, NC (US)

(72) Inventor: Shane Michael Meyer, Klamath Falls, OR (US)

(73) Assignee: JELD-WEN, INC., Charlotte, NC (US)

( * ) Notice: Subject to any disclaimer, the term of this patent is extended or adjusted under 35 U.S.C. 154(b) by 177 days.

(21) Appl. No.: 16/697,693

(22) Filed: Nov. 27, 2019

(65) Prior Publication Data

US 2021/0156192 A1 May 27, 2021

(51) Int. Cl.
*E05D 13/00* (2006.01)
*E06B 3/46* (2006.01)

(52) U.S. Cl.
CPC ..... *E06B 3/4618* (2013.01)

(58) Field of Classification Search
CPC ..... E06B 3/4618; E06B 3/4627
USPC ..... 49/213, 425, 409, 410
See application file for complete search history.

(56) References Cited

U.S. PATENT DOCUMENTS 2,493,162 A 1/1950 Olds
2,657,436 A * 11/1953 Fairhurst ..... E04B 2/827 52/64
2,944,282 A * 7/1960 Greco ..... E04B 2/827 16/87 R
3,334,375 A * 8/1967 Hubbard ..... E05D 15/0608 16/97
3,855,732 A 12/1974 Sheaf
4,098,027 A 7/1978 Crance
4,573,286 A * 3/1986 Favrel ..... E05D 15/0626 49/214
4,639,970 A 2/1987 Adams
4,688,352 A * 8/1987 Kinoshita ..... E05D 15/10 49/209

(Continued)

FOREIGN PATENT DOCUMENTS

DE 4402464 C1 * 5/1995 ..... E05D 15/1042
EP 1400653 B1 3/2005

(Continued)

OTHER PUBLICATIONS

International Search Report and Written Opinion for International Application No. PCT/US2019/063579, dated Feb. 6, 2020, 9 pages.

*Primary Examiner* — Jerry E Redman
(74) *Attorney, Agent, or Firm* — Lorenz & Kopf, LLP

(57) ABSTRACT

The disclosure relates to a sliding fenestration system assembly, such as a door or window system. The sliding fenestration system includes a sill having a first track channel and a second track channel formed thereon. A sill track including a first track segment, a second track segment, and a third track segment is coupled to the sill such that the first track segment is positioned within the first track channel, the third track segment is positioned within the second track channel, and the second track segment extends between the first and second track channels. The system further includes a sliding panel having one or more bottom guide assemblies, the assemblies engaging the sill track and operable to accommodate movement of the sliding panel along the sill track to reduce friction at a sealing interface between the sliding panel and the fenestration frame assembly.

20 Claims, 10 Drawing Sheets

(56) References Cited

U.S. PATENT DOCUMENTS 5,022,454 A * 6/1991 Kobayashi ..... E05D 15/0608 160/197
5,090,171 A * 2/1992 Kano ..... E04B 2/827 52/243.1
5,351,442 A * 10/1994 Gingras ..... E05D 15/1042 49/411
5,461,829 A 10/1995 Lehto et al.
6,052,944 A 4/2000 Louda
6,497,072 B2 12/2002 Fries
6,718,695 B1 4/2004 Park
6,826,867 B1 * 12/2004 McDonald ..... E05B 65/0835 49/209
7,021,007 B2 4/2006 Jacobs
7,024,821 B2 4/2006 Lu
7,143,474 B2 12/2006 Welsch et al.
7,165,497 B2 1/2007 Gilbert et al.
7,506,773 B2 3/2009 Welsch et al.
7,610,718 B2 11/2009 Kopish
7,647,728 B2 1/2010 Bortoluzzi
7,647,729 B2 1/2010 Polus
7,735,190 B2 6/2010 Welsch et al.
8,434,946 B2 5/2013 Watson
8,533,997 B2 9/2013 Stoutenborough et al.
8,894,284 B2 11/2014 Watson
9,157,267 B2 * 10/2015 Pelekanos ..... E05D 13/00
9,470,028 B2 * 10/2016 Header ..... E05D 15/1065
9,637,961 B2 * 5/2017 Header ..... E05D 15/10
9,739,080 B2 * 8/2017 Yoon ..... E05F 3/18
10,822,863 B2 * 11/2020 Bernhagen ..... E06B 3/4609
10,982,477 B2 * 4/2021 Procton ..... E05B 65/0835
2002/0053166 A1 * 5/2002 Fries ..... E05D 15/10 49/213
2004/0159048 A1 8/2004 Jacobs
2008/0066384 A1 3/2008 Yu
2013/0312333 A1 11/2013 Liao
2016/0076293 A1 3/2016 Halfon et al.
2018/0266169 A1 * 9/2018 Wray ..... E06B 7/16

FOREIGN PATENT DOCUMENTS

EP 1966463 B1 4/2016
WO WO-2014021641 A1 * 2/2014 ..... E06B 7/26

* cited by examiner

BIAXIAL TRACK SYSTEM FOR FENESTRATION PANELS

TECHNICAL FIELD

The field of this disclosure relates generally to sliding fenestration systems, and more particularly, to such systems designed to accommodate biaxial movement of the sliding panel to reduce friction during operation of the sliding panel.

BACKGROUND

Conventional fenestration systems typically include a sill assembly located along the lower portion of the fenestration frame, where the sill assembly provides a transition between the exterior environment and the interior region of a building or dwelling. In many designs, sill assemblies incorporate a seal to help serve as a weather-proofing barrier for the doorway, where the seal helps divert water and other debris away from the fenestration system and interior of the building to avoid mildew, rot, or other water damage. In a sliding fenestration system, the sill assembly further includes a track for supporting the sliding movement of the fenestration panel. Typically, the fenestration panel is supported along its lower portion by one or more carriage systems that incorporate wheels, rollers, or other suitable guide mechanisms, where the carriage systems engage the track and ensure that the fenestration panel travels smoothly along the lower track of the sill assembly without dislodging.

To provide a suitable seal along the interface between the sliding fenestration panel and the seal, many fenestration systems are designed such that the fenestration panel always contacts the seal and slides against the seal when the panel is opened or closed. Since fenestration panels tend to be heavy and much of their weight is supported along their bottom portion by the carriage systems, substantial sliding friction is created at the interface between the seal and the sliding panel. Such friction may lead to difficulty operating the sliding fenestration system due to the force required to open and close the fenestration panel and may also cause significant wear to the seal, thereby degrading water performance of the overall sill assembly.

Some conventional solutions use a lift and slide design where a handle is operated to lift the door away from the sealing mechanism and eliminate friction at the interface, the door being easily slidable while in its lifted state to reduce operational force. Such designs, however, rely on complex hardware that complicates assembly of the fenestration system and increases overall manufacturing costs.

Accordingly, the present inventor has identified a need for an improved sliding fenestration system with a streamlined design to minimize manufacturing costs and facilitate ease of use, while maintain proper sealing and significantly reducing sliding friction during operation of the sliding panel. Additional aspects and advantages will be apparent from the following detailed description of example embodiments, which proceeds with reference to the accompanying drawings.

DETAILED DESCRIPTION OF EXAMPLE EMBODIMENTS

Figure 1:
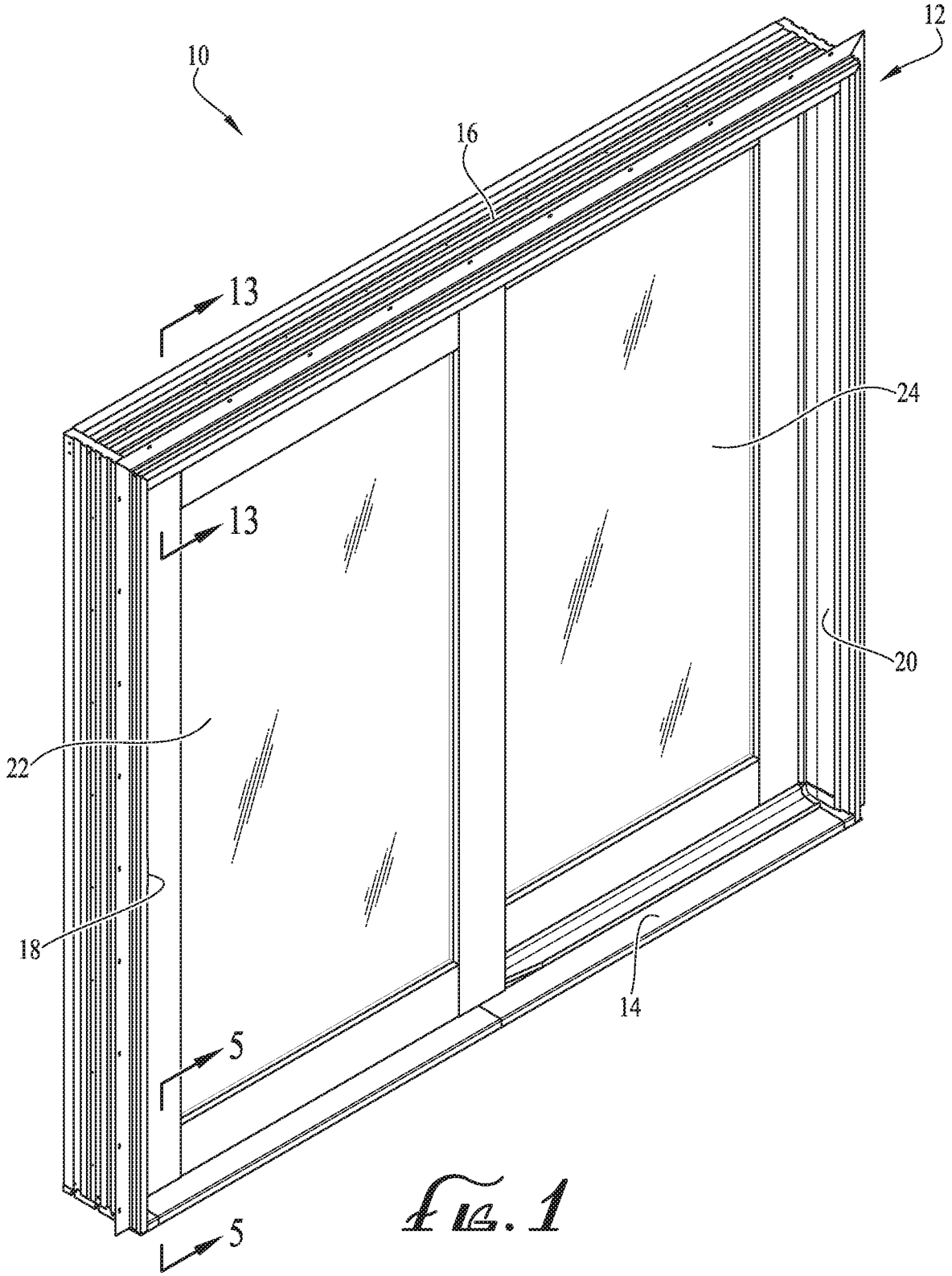
FIG. 1 is a perspective view of a sliding fenestration system in accordance with one embodiment.

With reference to the drawings, this section describes embodiments of a sliding fenestration system and its detailed construction and operation. Throughout the specification, reference to "one embodiment," "an embodiment," or "some embodiments" means that a described feature, structure, or characteristic may be included in at least one embodiment of the sliding fenestration system. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

FIGS. 1-15 collectively illustrate various embodiments and features of a sliding fenestration system 10 that is operable for providing access into or out of a building or dwelling. The fenestration system 10 includes a movable sliding panel 22 designed to be guided along sill tracks 54, 55 of the sill assembly 14 via one or more guide assemblies, such as rollers 26 (or rollers 112) or other suitable guide means, to accommodate the sliding action of the panel 22. It should be understood that the term "sliding" as used in the specification and claims is meant to be inclusive of both doors that slide over plain bearing surfaces as well as rollers and other support methods allowing the door to glide or smoothly move along a horizontal axis (or other axis)

relative to the frame assembly. The sill assembly 14 includes a sill 28 with dual track channels 46, 48 and sill tracks 54, 55 coupled within the track channels 46, 48 for accommodating biaxial (or multi-axial) movement (e.g., movement along multiple directions, such as both a longitudinal and lateral direction) of the sliding panel 22. The biaxial or multi-axial movement of the sliding panel 22 allows the panel 22 to move away from a sealing interface of the fenestration system 10 for reducing or eliminating sliding friction during operation of the sliding panel 22.

The fenestration system 10 may include multiple seals or sealing interfaces collectively comprising the overall sealing interface of the fenestration system 10. For example, the fenestration system 10 may include seals installed on the sill assembly 14, the head assembly 16, the jambs 18, 20, and the fixed panel 24, or the sliding panel 22 may include seals that interact with each of these components at various interfaces to provide proper sealing for the fenestration system 10. For ease of reference, the following disclosure illustrates one example sealing interface 30 formed on the sill assembly 14 (see FIG. 2) that may include a weatherstrip or other seal 31 coupled thereto in a fixed configuration. In other embodiments, the seal 31 may instead be coupled to the sliding panel 22 for movement therewith, where the sealing interface 30 and seal 31 interact with one another during operation of the sliding panel 22. It should be understood that the reference to sealing interface 30 is intended as an example to illustrate how the tracks 54, 55 of the fenestration system 10 allow the sliding panel 22 to move or shift away from the overall sealing interface of the fenestration system 10, and not just from the sealing interface 30 of the sill assembly 14.

As further described in detail below with reference to the figures, the sill tracks 54, 55 feature bends/curves designed to guide the rollers 26 along the track formed by the sill tracks 54, 55 to accommodate the biaxial movement of the sliding panel 22. The sill tracks 54, 55 further include a clearance portion 62 to accommodate the transition of the sill tracks 54, 55 from one track channel 46 to an adjoining track channel 48 when the tracks 54, 55 are coupled to the sill assembly 14. The rollers 26, 112 are designed to rotate around multiple axes to provide the rollers 26, 112 with the necessary degree of freedom to smoothly follow the bends/curves of the sill tracks 54, 55 without dislodgement of the sliding panel 22. Additional details of each of these components and other embodiments relating to the design of the sill assembly 14 and rollers 26, 112 are described in further detail below with reference to the figures.

FIG. 1 illustrates a sliding fenestration system 10, such as a sliding door or window system, for use in a building, dwelling, or other suitable structure. With reference to FIG. 1, the fenestration system 10 includes a frame structure 12 having a sill assembly 14, a head assembly 16, and a pair of jambs 18, 20. The frame structure 12 supports one or more panels 22, 24 typically made of glass that may be opaque, transparent, or translucent. In some embodiments, the fenestration system 10 may include only one sliding panel 22, while the other panel 24 is stationary. In other embodiments, both panels 22, 24 may be independently movable. Movement of the sliding panel 22 along the sill assembly 14 is guided by one or more guide assemblies or rollers 26, 112 coupled along a bottom portion of the sliding panel 22. Additional details of the sill assembly 14, the rollers 26, 112, and other components of the sliding fenestration system 10 for accommodating the sliding action of the panel 22 are provided with collective reference to FIGS. 2-15, each of which being further discussed in turn below.

Figure 2:
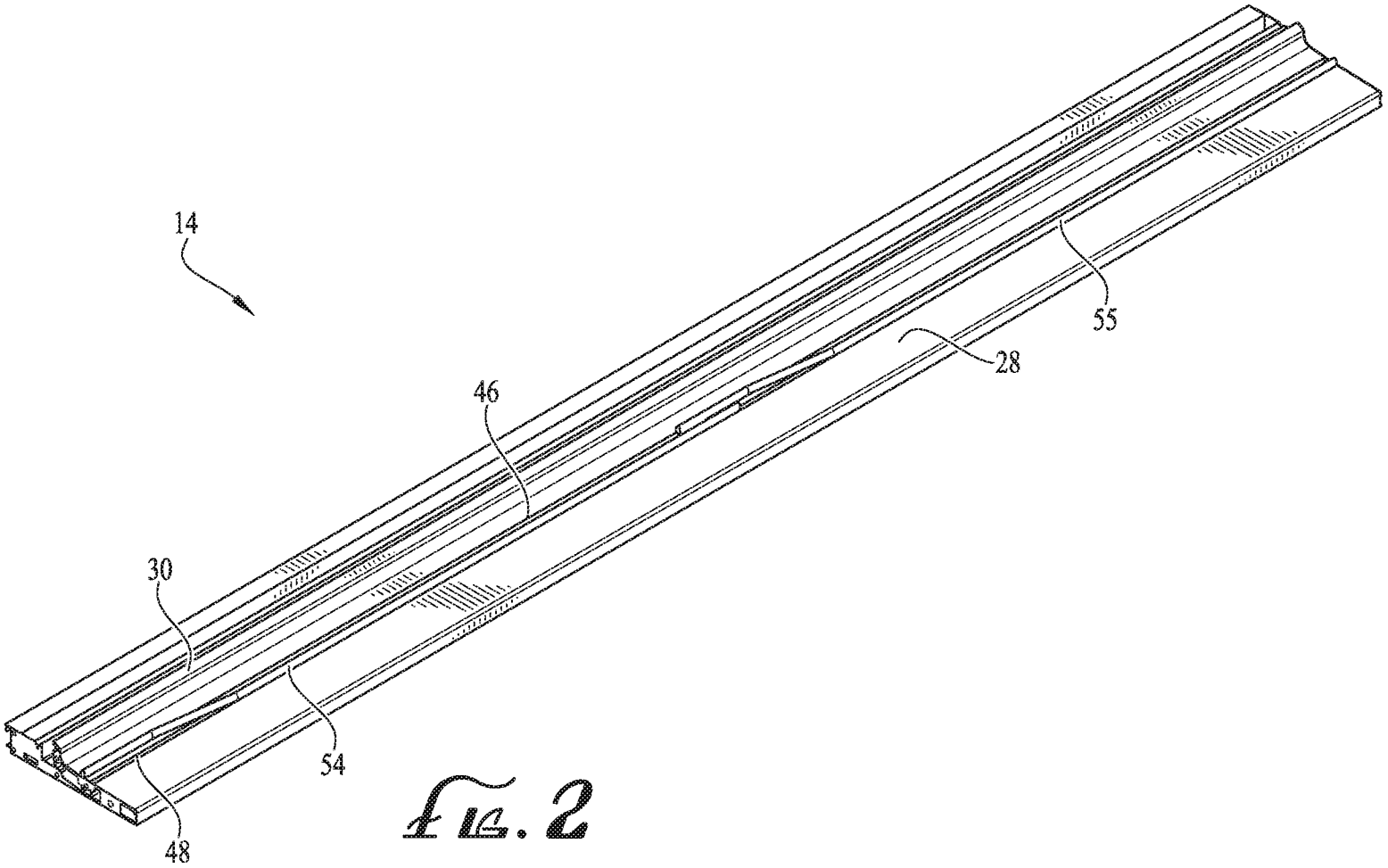
FIG. 2 is a perspective view of an example embodiment of a sill assembly for the sliding fenestration system of FIG. 1.

FIG. 2 illustrates an example embodiment of the sill assembly 14 for use in an entryway of a building or dwelling. It is noted that various features of the sliding fenestration system 10 have been removed from FIG. 2 to avoid obscuring pertinent aspects of the sill assembly 14. The sill assembly 14 includes an elongated sill 28 made of any one of a variety of materials, such as pultruded fiberglass, aluminum or other suitable materials. The sill 28 includes a seal interface 30 extending horizontally along the sill 28, the seal interface 30 interacting with a weatherstrip or seal 31 coupled to the sliding panel 22 (see FIG. 3) to help divert water and other debris from the interior of the dwelling. As noted previously, in other embodiments, the sill 28 may incorporate the seal 31 such that the seal 31 remains in a fixed position relative to the sliding panel 22 and engages a seal interface (not shown) of the sliding panel 22 during operation thereof. In some embodiments, the sill 28 may slope generally downwardly away from the sealing interface 30 to help further minimize water intrusion.

Figure 3:
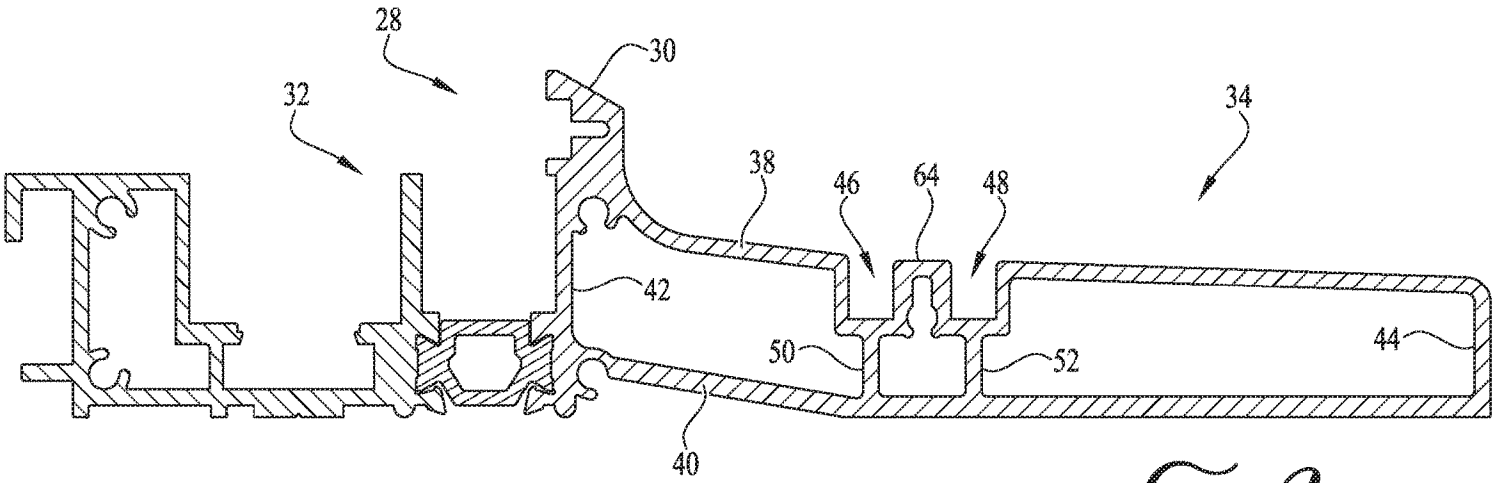
FIG. 3 illustrates features of a sill profile of the sill assembly of FIG. 2 in accordance with one embodiment.

FIG. 3 is a view illustrating an example profile of the sill 28 in accordance with one embodiment. With reference to FIG. 3, the sill 28 includes an interior extrusion 32 and an exterior extrusion 34, each of which having various ribs and flanges. The sill 28 includes a thermal break 36 positioned between the interior and exterior extrusions 32, 34 for stopping or slowing heat transfer between the extrusions 32, 34. The exterior extrusion 32 includes a pair of elongated frame members 38, 40 forming a generally upper portion and a generally lower portion of the sill 28. The sill 28 includes a plurality of vertical legs 42, 44 extending between the frame members 38, 40 and designed for supporting the frame members 38, 40 of the sill 28. It should be understood that in other embodiments, the sill 28 may have an altered profile without departing from the principles of the disclosed subject matter.

The exterior extrusion 34 includes a pair of track channels 46, 48 that are offset from one another and formed along the upper frame member 38, the track channels 46, 48 extending along a portion or the entirety of the horizontal length of the sill 28. In one embodiment, the channels 46, 48 each extend along a respective horizontal axis and are arranged generally parallel to one another, and generally parallel to the sealing interface 30 of the sill 28. In other embodiments, the track channels 46, 48 may not be generally parallel to one another, but may instead be curved or arranged in other configurations. In some embodiments, the track channels 46, 48 are supported underneath by legs 50, 52, respectively, the legs 50, 52 each connecting to the lower frame member 40. As further described in detail below, the track channels 46, 48 each receive and secure a sill track 54, 55 that engages with the rollers 26, 112 to accommodate the sliding movement of the panel 22.

It should be understood that while the sill 28 is illustrated with a pair of track channels 46, 48, other embodiments may include designs with additional track channels to accommodate additional sill tracks as desired. In addition, it should also be understood that while the track channels 46, 48 and sill tracks 54, 55 are illustrated along the exterior extrusion 34 of the sill 28, both the track channels 46, 48 and sill tracks 54, 55 may also be positioned along the interior extrusion 32 of the sill 28 without departing from the principles of the disclosed subject matter. Further details relating specifically to the sill tracks 54, 55 and their functionality are provided below with specific reference to FIGS. 4A and 4B.

Figure 4A:
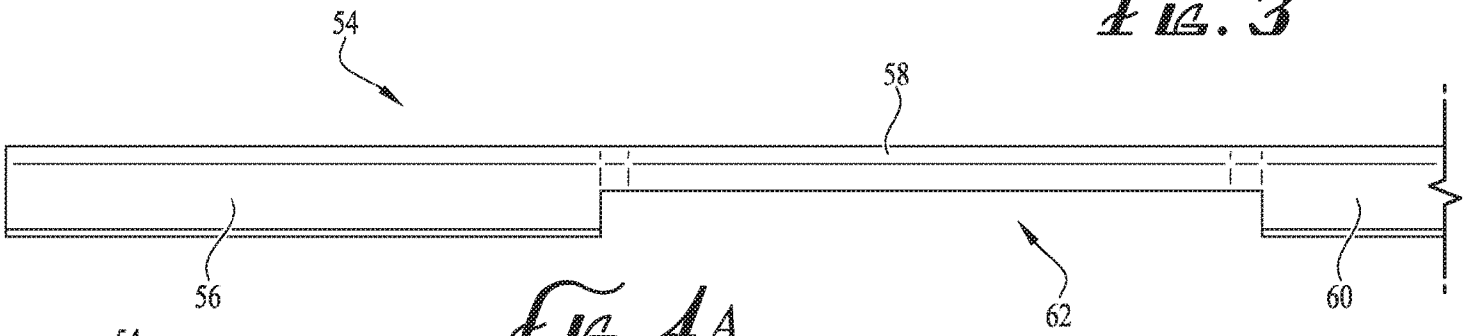
FIGS. 4A and 4B collectively illustrate a modular sill track for supporting biaxial movement of a sliding panel along the sill assembly in accordance with one embodiment.
Figure 4B:
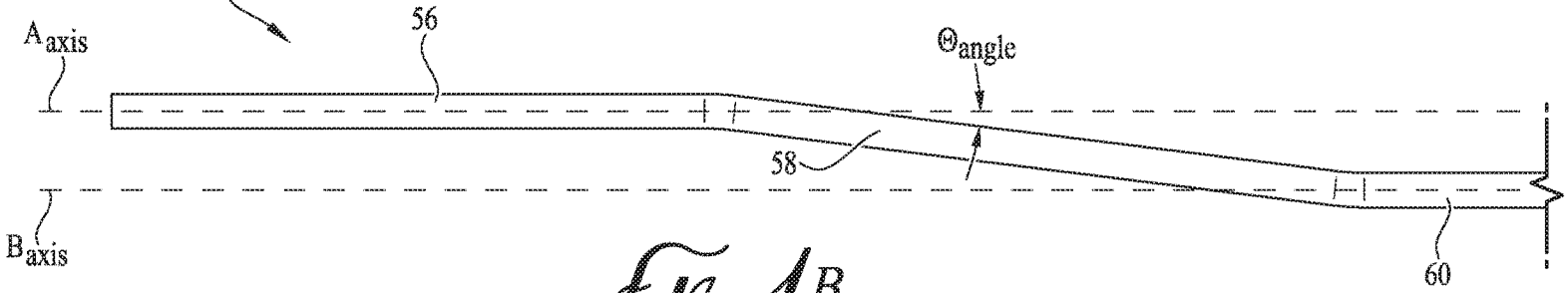

FIGS. 4A and 4B collectively illustrate a modular sill track 54 for supporting biaxial (or multi-axial) movement of a sliding panel 22 along the sill assembly 14 in accordance with one embodiment. It is noted that while the following description focuses on the sill track 54, the same features and characteristics apply to sill track 55. Accordingly, the following does not describe specific details relating to sill track 55 to avoid repetition.

With reference to FIGS. 4A and 4B, the sill track 54 includes a first track segment 56, a second track segment 58, and a third track segment 60. In some embodiments, the first track segment 56 may be shorter in length as compared to the third track segment 60. Preferably, the first track segment 56 is sufficiently long to provide a proper seal for the sill assembly 14, while still being sufficiently short to minimize the overall sliding friction while operating the sliding panel 22 as further discussed below. With reference to FIG. 4B, the first track segment 56 may extend along an axis A (or alternatively, aligned with a first plane), and the third track segment 60 may extend along an axis B (or alternatively, aligned with a second plane), with the second track segment 58 extending along a third axis (or alternatively, aligned with a third plane) and spanning between the first and third track segments 56, 60 to connect them to one another. The axes A and B (or alternatively, planes) are offset from one another and may be generally parallel to one another, in some embodiments, such that the first and third track segments 56, 60 are each substantially straight sections each aligned within a respective single plane.

As noted previously, the second track segment 58 extends between and connects the first and third track segments 56, 58, the second track segment 58 being bent at an angle θ relative to the axis A of the first track segment 56 (and forming the same angle relative to the axis B of the third track segment 58). The degree of the bend depends on various factors, such as the dimensions of the sill assembly 14, the positioning of the track channels 46, 48, and the length of the second track segment 58, for example. In some embodiments, the second track segment 58 may be bent at an angle ranging between 5° and 10° relative to the first and third track segments 56, 60 respectively. In other embodiments, the second track segment 58 may instead be arcuate or curved rather than being bent at a constant angle. The second track segment 58 further includes a recessed or cutaway region 62 designed to provide enough clearance and facilitate track crossover from the first track channel 46 to the second track channel 48 when the sill track 54 is installed in the sill 28.

In another embodiment, the first track segment 56 and the third track segment 60 may not be substantially straight sections disposed along parallel axes A and B, but rather may be arranged in different configurations. For example, in one embodiment, the first track segment 56 may extend along the horizontal axis A, and the third track segment 60 may be curved outwardly or arranged along an axis (or plane) where the third track segment 60 does not intersect horizontal axis A. In still other embodiments, the first and third track segments 56, 60 may not be straight sections at all, but may instead include curved profiles. Additional details relating to the sill tracks 54, 55 and their functionality are described below.

With reference to FIG. 2, the sill track 54 is inserted into the track channels 46, 48, where the first track segment 56 is inserted into and seated within the track channel 46, and the third track segment 60 is inserted into and seated within the track channel 48. In this configuration, the second track segment 58 extends over a region or wall 64 of the sill 28 (see FIG. 3) that separates the track channels 46, 48. Returning to FIG. 4A, the depth of the cutaway region 62 of the second track segment 58 is preferably sufficiently deep to allow the second track segment 58 to rest against the region or wall 64 when the sill track 54 is firmly seated within the track channels 46, 48 as described previously. While the second track segment 58 preferably rests against the region or wall 64, in other embodiments, the second track segment 58 may instead be offset from the region or wall 64.

The sill track 54 may be coupled within the track channels 46, 48 in any suitable fashion. For example, in some embodiments, the sill tracks 54, 55 may be designed to be press fit into the track channels 46, 48 to ensure the sill tracks 54, 55 are secure. In other embodiments, the track channels 46, 48 may include grooves (not shown) or other keyed features designed to engage with and secure the sill tracks 54, 55 firmly in position. As illustrated in FIG. 2, the sill assembly 14 may include two sill tracks 54, 55 where the second sill track 55 is offset from the first sill track 54 on the sill assembly 14, the second sill track 55 arranged within the first and second track channels 46, 48 in a substantially identical manner as the first sill track 54. In a completed assembly, each sill track 54, 55 receives a corresponding bottom roller 26 (or roller 112) coupled to the sliding panel 22, where the sill tracks 54, 55 cooperate to accommodate the sliding action of the panel 22.

Collectively, the sill tracks 54, 55 form the track for the bottom rollers 26, 112 to accommodate the biaxial or multi-axial movement of the sliding panel 22 as further described in detail below. Briefly, each respective track segment 56, 58, 60 may form a corresponding track portion for the bottom rollers 26, 112, where the first track portion is aligned with a first axis or plane, the second track portion is aligned with a second axis or plane, and the third track portion is aligned with a third axis or plane offset from the first plane (and parallel thereto in some embodiments). As noted in the figures, the second track segment is arranged at an angle relative to the first and third track segments. As further described in detail below, the various axes or planes at which the respective track portions are arranged are designed to accommodate the movement of the sliding panel 22.

Preferably, the sill tracks 54, 55 are designed to be a modular component that can be customized as needed to accommodate different sizes (e.g., different sill lengths and widths) for the sliding fenestration systems 10. Accordingly, the length of the first and third track segments 56, 60 may be different than the embodiment illustrated depending on the dimensions of the sliding fenestration systems employing the design. Additionally, in other embodiments, the length and degree of bend or curvature of the second track segment 58 may differ depending on the separation distance between the track channels 46, 48 on the sill 28. One having ordinary skill in the art would understand that alterations to these dimensions do not depart from the principles and concept of the described subject matter.

Figure 5:
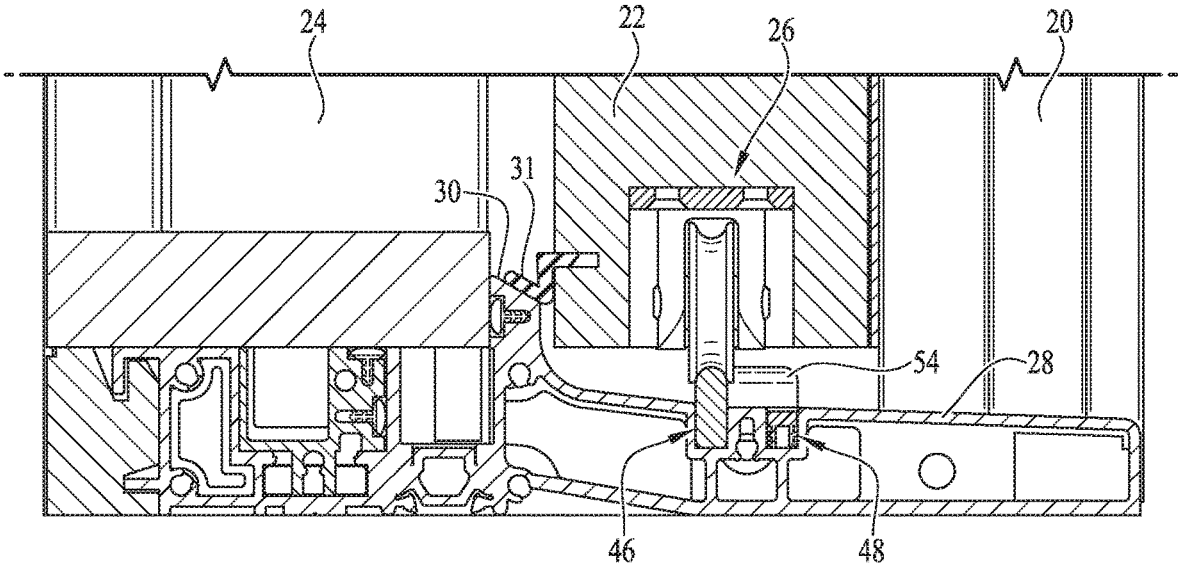
FIGS. 5 and 6 are each cross-sectional detail views illustrating the sliding fenestration system in a closed and opened position at the sill assembly, respectively, in accordance with one embodiment.
Figure 6:
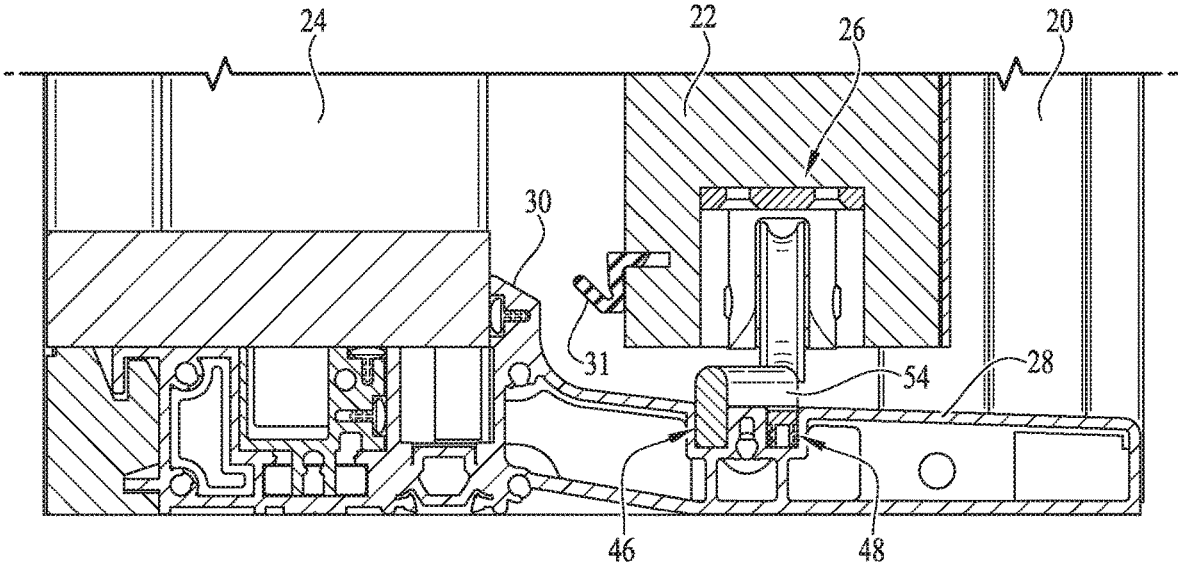

FIGS. 5 and 6 are each cross-sectional detail views of section 5-5 (see FIG. 1) illustrating the sliding fenestration system 10 in a closed and opened position, respectively, in accordance with one embodiment. With collective reference to FIGS. 5 and 6, the following provides a brief description of the sliding movement of the panel 22 on the tracks 54, 55 during operation. As illustrated in FIG. 5, the sliding panel 22 includes a bottom roller 26 (or alternatively roller 112 of FIG. 8A) coupled along a bottom surface of the sliding panel 22, the bottom roller 26 supporting the sliding panel 22 along the track formed by the sill tracks 54, 55, where the bottom roller 26 is operable to ride along the first, second, and third track segments 56, 58, 60 of the sill tracks 54, 55.

The sliding panel 22 may include multiple bottom rollers 26 supporting the sliding panel 22. For example, in one embodiment, the sliding panel 22 may include a first bottom roller 26 positioned along a first bottom corner of the sliding panel 22 (e.g., positioned adjacent the jamb 18 in FIG. 1), and a second bottom roller 26 positioned along an opposite second bottom corner of the sliding panel 22 (e.g., positioned adjacent the midpoint where the first and second panels 22, 24 meet. In another embodiment, such as for wider doors, the sliding panel 22 may include additional bottom rollers as needed to support the weight of the sliding panel 22 and facilitate the sliding action. Additional details of the bottom roller 26 (and bottom roller 112) are provided below with specific reference to FIGS. 7A, 7B, 8A, and 8B.

Returning to FIG. 5, the bottom roller 26 engages the sill tracks 54, 55 and is designed to follow the tracks 54, 55 as the sliding panel 22 is operated. In some embodiments, when the sliding panel 22 is in a closed position, the bottom roller 26 may be positioned along the first track segment 56 of the tracks 54, 55, whereat the seal 31 of the sliding panel 22 contacts the seal interface 30 on the sill 28 to ensure the sliding fenestration system 10 is properly sealed. As noted previously, in other embodiments, the sill 28 may instead include the seal and the sliding panel 22 may instead include the seal interface, with these components contacting one another when the sliding panel 22 is in the closed position.

As the sliding panel 22 is opened along a first direction of motion, the bottom roller 26 rides along the first track segment 56 and transitions onto the second track segment 58 of the tracks 54, 55, the second track segment 58 being angled or curved away from the seal interface 30 as described previously. Accordingly, the sliding panel 22 and the seal 31 are guided away from the seal interface 30 along a second direction of motion different from the first direction of motion and outside the axis or plane of the first track segment 56, thereby allowing the sliding panel 22 to be moved with minimal or no sliding friction relative to the seal interface 30 in this position. With reference to the cross-section view in FIG. 6, as the sliding panel 22 is more fully opened, the bottom roller 26 transitions from the second track segment 58 to the third track segment 60 of the tracks 54, 55 and moves in a third direction of motion different from the second direction of motion along the length of the third track segment 60 while in the open position. As illustrated, the seal 31 carried on the sliding panel 22 is offset and separated from the seal interface 30 as the bottom roller 26 transitions onto the third track segment 60.

Figure 7A:
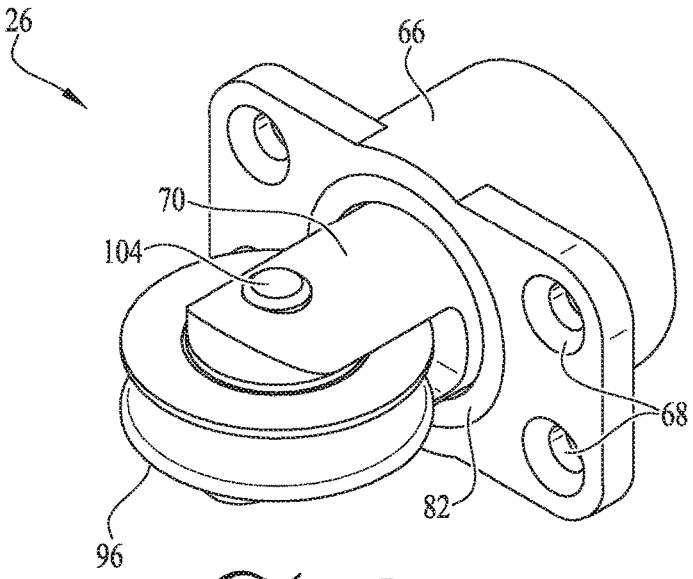
FIGS. 7A and 7B collectively illustrate an example embodiment of a bottom roller for accommodating the sliding action of the sliding panel along the sill assembly.
Figure 7B:
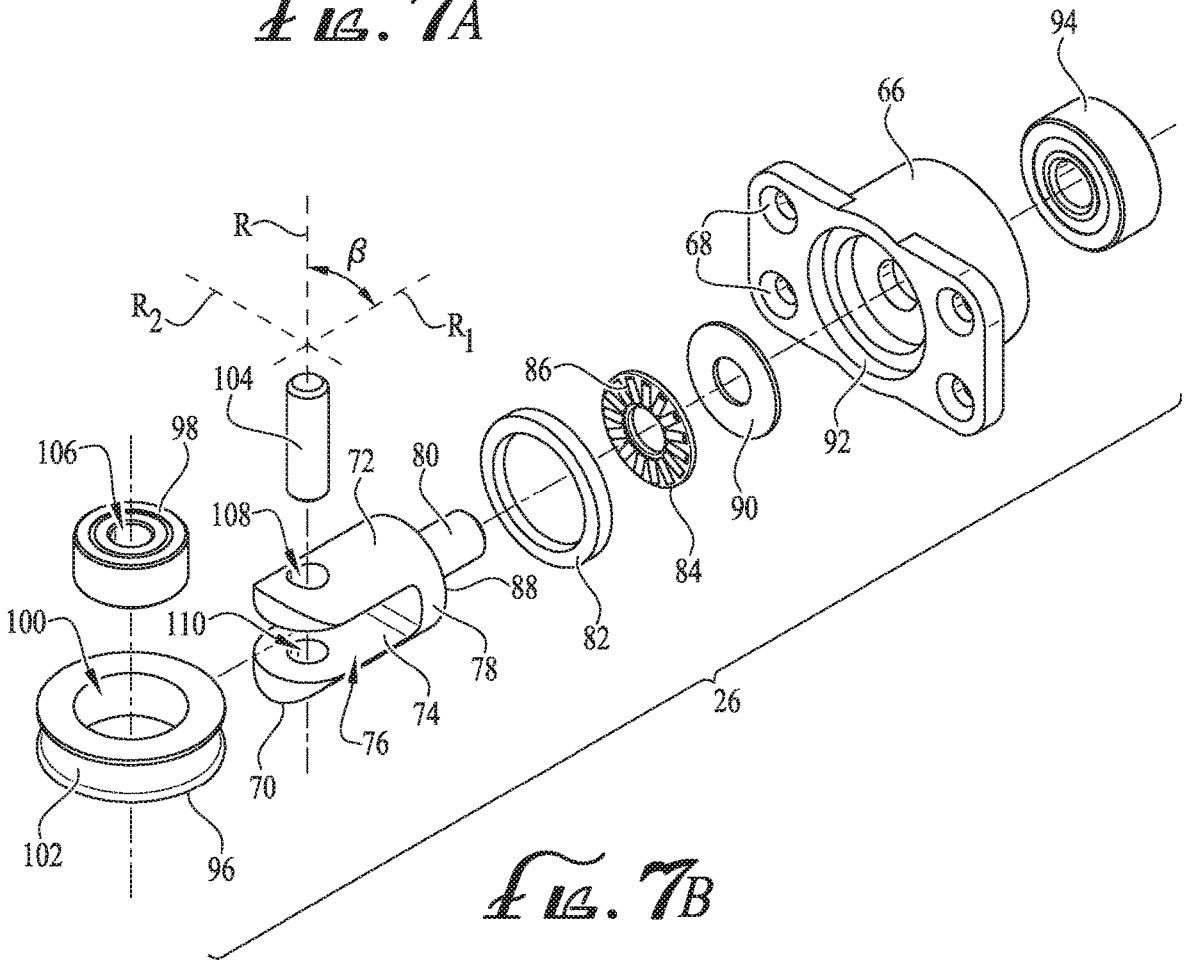

FIG. 7A illustrates a view of the bottom roller 26 and FIG. 7B is an exploded view of the bottom roller 26 in accordance with one embodiment. As noted previously, the bottom roller 26 is merely one example embodiment of a guide assembly that may be used to accommodate the sliding or movement of the panel 22. In other embodiments, guide means other than rollers or castors may be used. With collective reference to FIGS. 7A and 7B, the following describes features of the bottom roller 26 and its functionality to accommodate the movement of the sliding panel 22 along the sill tracks 54, 55. The bottom roller 26 includes a base 66 designed to house multiple components of the bottom roller 26, the base 66 further including a plurality of fastener openings 68 formed thereon to accommodate coupling of the bottom roller 26 to the sliding panel 22, such as via fasteners (not shown). The bottom roller 26 further includes a roller support 70 having a first leg 72 and a second leg 74 separated from one another to form a slot 76 therebetween. The roller support 70 includes a base 78 supporting the legs 72, 74, and further includes a shaft 80 extending upwardly from the base 78. The base 78 includes a grease seal 82 encircling the base 78 between the shaft 80 and a position of the legs 72, 74. A thrust needle bearing 84 including a plurality of cylindrical rollers 86 sits against an upper surface 88 of the base 78 and surrounds the shaft 80, and a thrust bearing washer 90 sits on the needle bearing 86 also surrounding the shaft 78. As noted previously, in an assembled configuration, the base 66 surrounds the components of the bottom roller 26 as illustrated in FIG. 7A, with the grease seal 82 seated within a shoulder 92 of the base 66, and a roller bearing 94 seated within the base 66 and surrounding the shaft 78.

The bottom roller 26 includes a roller wheel 96 having a roller bearing 98 positioned within an opening 100 of the roller wheel 96. The roller wheel 96 includes a grooved track 102 formed along a circumference of the roller wheel 96, the grooved track 102 designed to sit against and ride the sill tracks 54, 55 of the sill 28 as the roller wheel 96 rotates. In an assembled configuration, the roller wheel 96 is positioned within the slot 76 formed between the first and second legs 72, 74 and is secured in position within the roller support 70 via an axle 104 extending between an opening 106 of roller bearing 98 and also extending between corresponding openings 108, 110 formed on the first and second legs 72, 74, respectively. As designed, the components of the bottom roller 26 accommodate rotational movement of the roller wheel 96 as the sliding panel 22 is moved, and also allow the roller wheel 96 to deviate from an axis of rotation R to provide the roller wheel 96 with a sufficient degree of freedom in following the bends or curvature of the sill tracks 54, 55 as further described below.

With reference to FIG. 7B, the axle 104 accommodates rotational movement of the roller wheel 96 about an axis of rotation R extending through the axle 104. When the roller wheel 96 is positioned along the first and third track segments 56, 60, the axis of rotation of the roller wheel 96 substantially overlaps with the axis of rotation R since the first and third track segments 56, 60 are relatively straight track sections in the embodiments described previously. However, to negotiate the bend as the roller wheel 96 transitions onto the second track segment 58 (either from the first track segment 56 or the third track segment 60), the roller wheel 96 may rotate about a second axis of rotation, such as axis $R_1$ or axis $R_2$, each of which being formed at an angle $\beta$ relative to the first axis of rotation R. The angle $\beta$ may be substantially equal to (or larger than) the angle $\theta$ defining the bend of the second track segment 58 to ensure the roller wheel 96 can move with a necessary degree of freedom to travel along the sill tracks 54, 55. In some embodiments, the angle $\beta$ ranges between 0° and 10°. In other embodiments, the angle $\beta$ may be different depending on the bent or curvature of the sill tracks 54, 55.

Figure 8A:
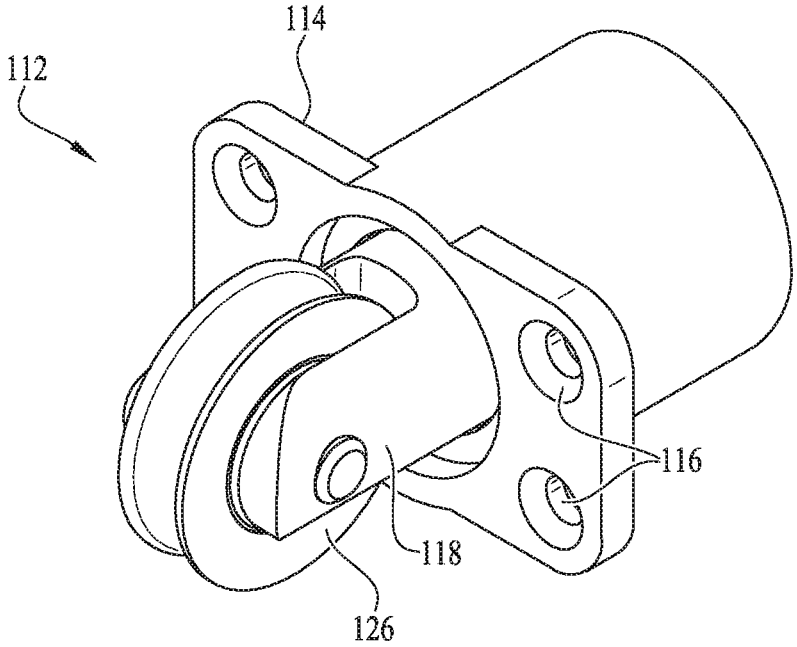
FIGS. 8A and 8B collectively illustrate another example embodiment of a bottom roller for accommodating the sliding action of the sliding panel along the sill assembly.
Figure 8B:
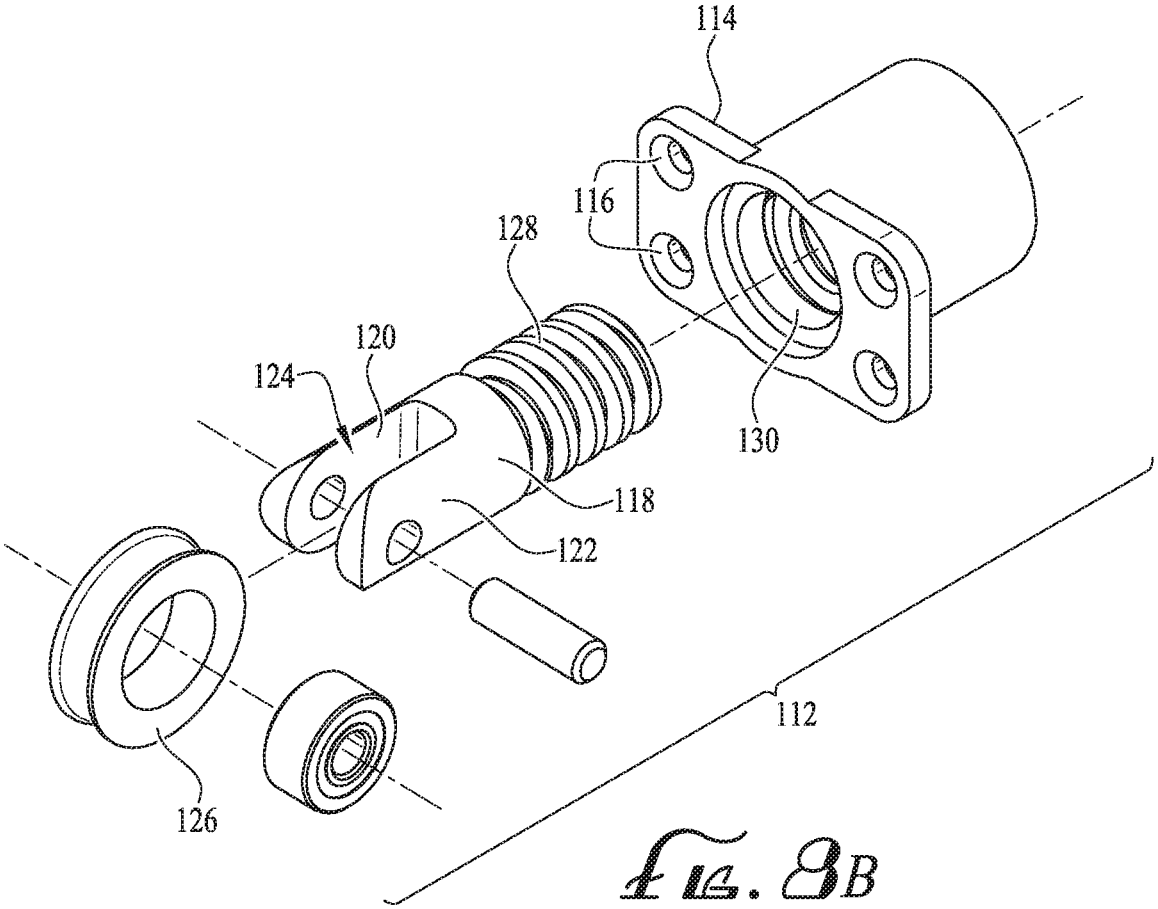

FIGS. 8A and 8B collectively illustrate another example embodiment of a bottom roller 112 for accommodating the sliding action of the sliding panel 22 along the sill tracks 54, 55 of the sill assembly 14. With reference to FIGS. 8A and 8B, the bottom roller 112 includes a base 114 having fastener openings 116 formed thereon to accommodate coupling of the bottom roller 112 to the sliding panel 22, such as via fasteners (not shown). The bottom roller 112 further includes a roller support 118 having a first leg 120 and second leg 122 separated from one another to form a slot 124 therebetween, the slot 124 designed to receive a roller wheel 126 in a similar fashion as described previously with reference to the bottom roller 26 of FIGS. 7A and 7B. The roller wheel 126 is designed to rotate about multiple axes of rotation and has substantially similar features arranged in a substantially similar way relative to the roller wheel 96 of FIGS. 7A and 7B. Accordingly, to avoid repetition, such details are not further described herein with the understanding that the same features and characteristics described previously apply to the roller wheel 126.

With reference to FIG. 8B, the roller support 118 includes a threaded shaft 128 formed along an opposite end relative to the legs 120, 122. An interior portion 130 of the base 114 includes corresponding threads, the threaded interior portion 130 designed to receive the threaded shaft 126 of the roller support 118. In operation, the threaded components allow the roller support 118 to pivot within the base 114 as needed to allow the roller wheel 126 to rotate and ride along the sill tracks 54, 55. In addition, the threaded components also accommodate height adjustments to adjust the roller wheel 126 in relation to the sliding panel 22 as needed, such as by rotating the threaded shaft 128 until the roller wheel 126 is at a desired height.

To accommodate the biaxial movement of the sliding panel 22 as discussed with reference to the embodiments of FIGS. 1-8, the head assembly 16 of the sliding fenestration system 10 is outfitted with similar components and features as described previously with reference to the sill assembly 14. With reference to FIGS. 9-15, the following discusses additional details of the head assembly 16 and focuses on certain components designed for accommodating the biaxial movement.

Figure 9:
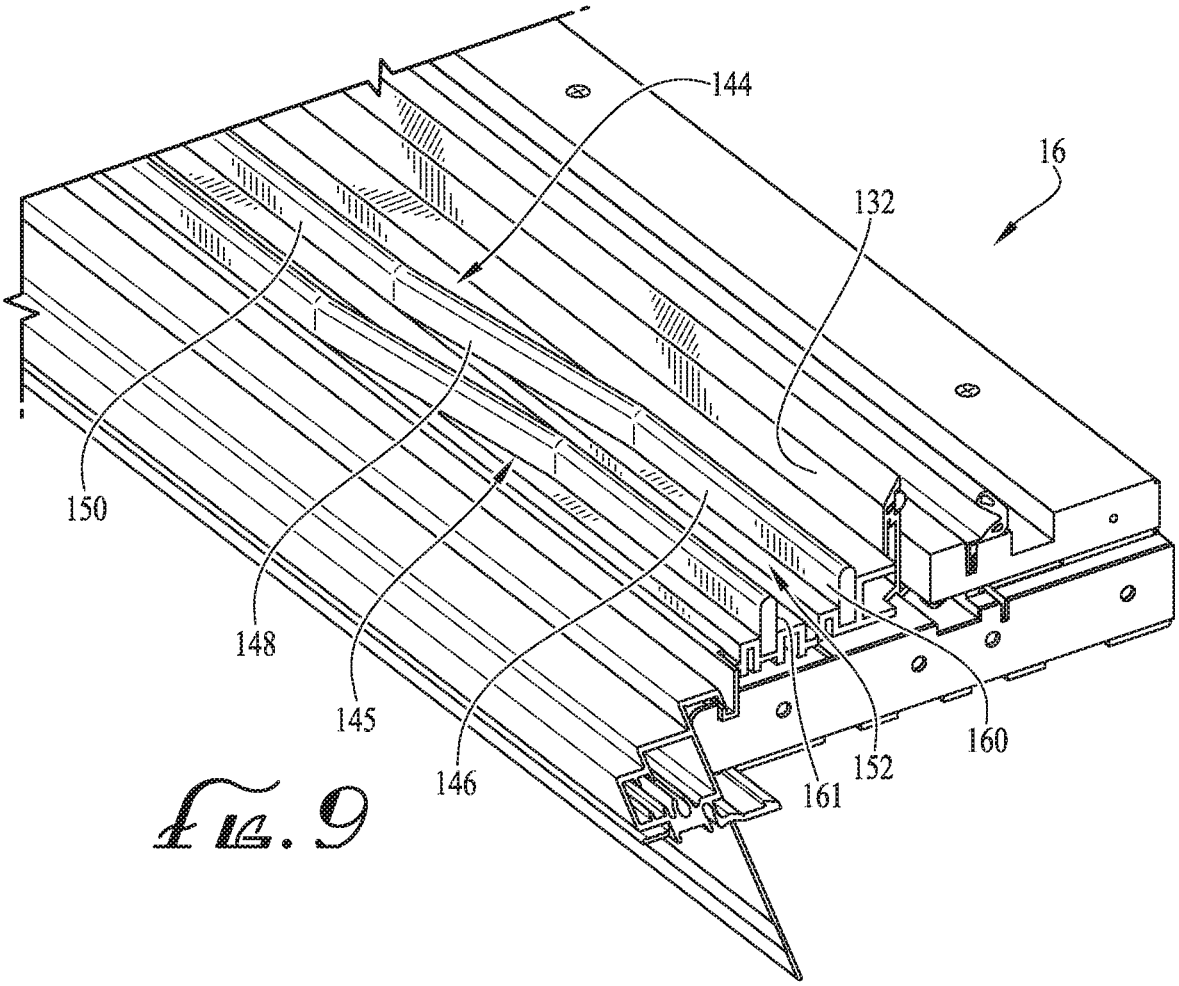
FIGS. 9-11 collectively illustrate details of a head assembly of the sliding fenestration system of FIG. 1, the head assembly including modular head tracks for supporting biaxial movement of the sliding panel.
Figure 10:
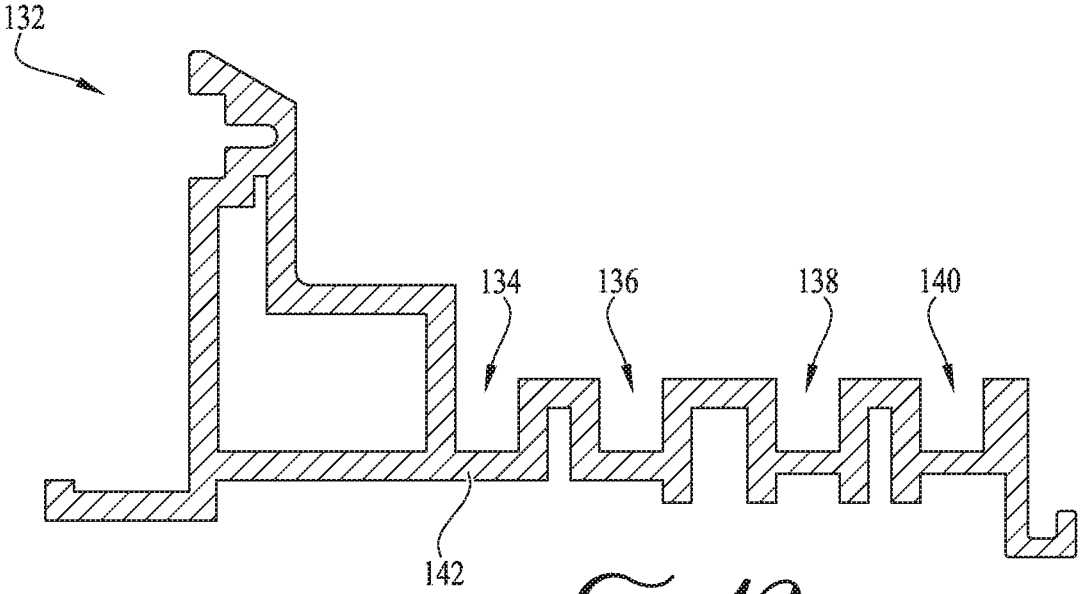

FIG. 9 illustrates an underside of the head assembly 16 of the sliding fenestration system 10 of FIG. 1, and FIG. 10 illustrates details of an example profile of a head 132 of the head assembly 16. With collective reference to FIGS. 9 and 10, the head 132 includes multiple head track channels 134, 136, 138, 140 formed along a frame member 142 of the head 132. The head track channels 134, 136, 138, 140 are generally parallel to one another and extend along a horizontal axis of the head 132. The head track channels 134, 136, 138, 140 are designed to receive head tracks 144, 145 arranged in a similar fashion as described previously with reference to the sill tracks 54, 55 of the sill assembly 14. As further discussed below, the head tracks 144, 145 operate to accommodate the sliding movement of the panel 22.

Briefly, the head tracks 144, 145 each include a first track segment 146, a second track segment 148, and a third track segment 150, each respective track segment having a similar configuration and functionality as described previously with respect to sill track 54. To avoid repetition, those features are not further described herein with the understanding that the same description related to sill track 54 applies equally to head track 144.

Figure 11:
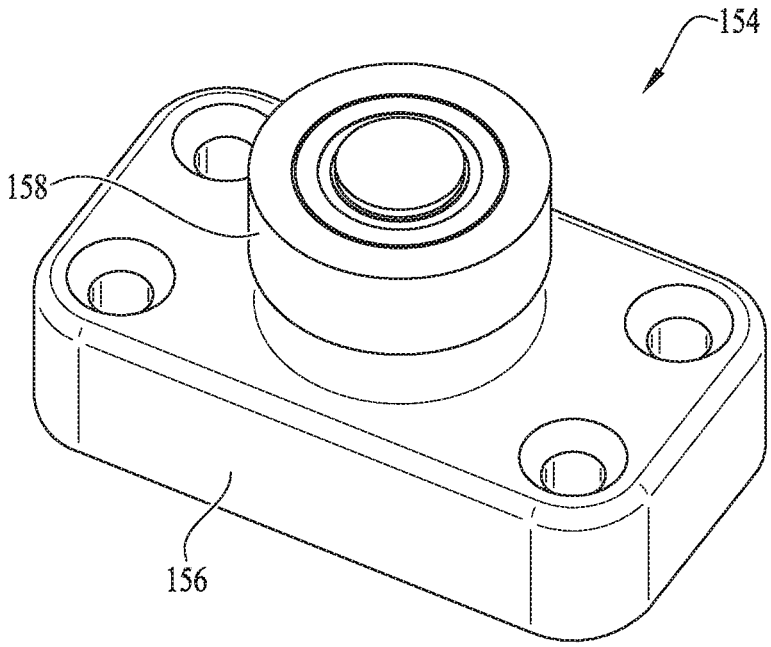

As illustrated in FIG. 9, the head tracks 144, 145 are inserted and seated within the respective track channels 134, 136, 138, 140 in a similar fashion as discussed previously, but the configuration of the head tracks 144, 145 is altered to accommodate the horizontal orientation of the head roller 154. As illustrated in FIG. 11, the head roller 154 includes a base 156 and a roller 158 coupled to the base 156, where the base 156 is in turn coupled to the sliding panel 22 for movement therewith. Although the description focuses on a single head roller 154, it should be understood that the sliding panel 22 may include multiple head rollers 154 as needed to accommodate the desired sliding movement of the sliding panel 22. Additional details of the head track configuration and operation details of the head assembly 16 for accommodating movement of the sliding panel 22 are discussed below.

Figure 12:
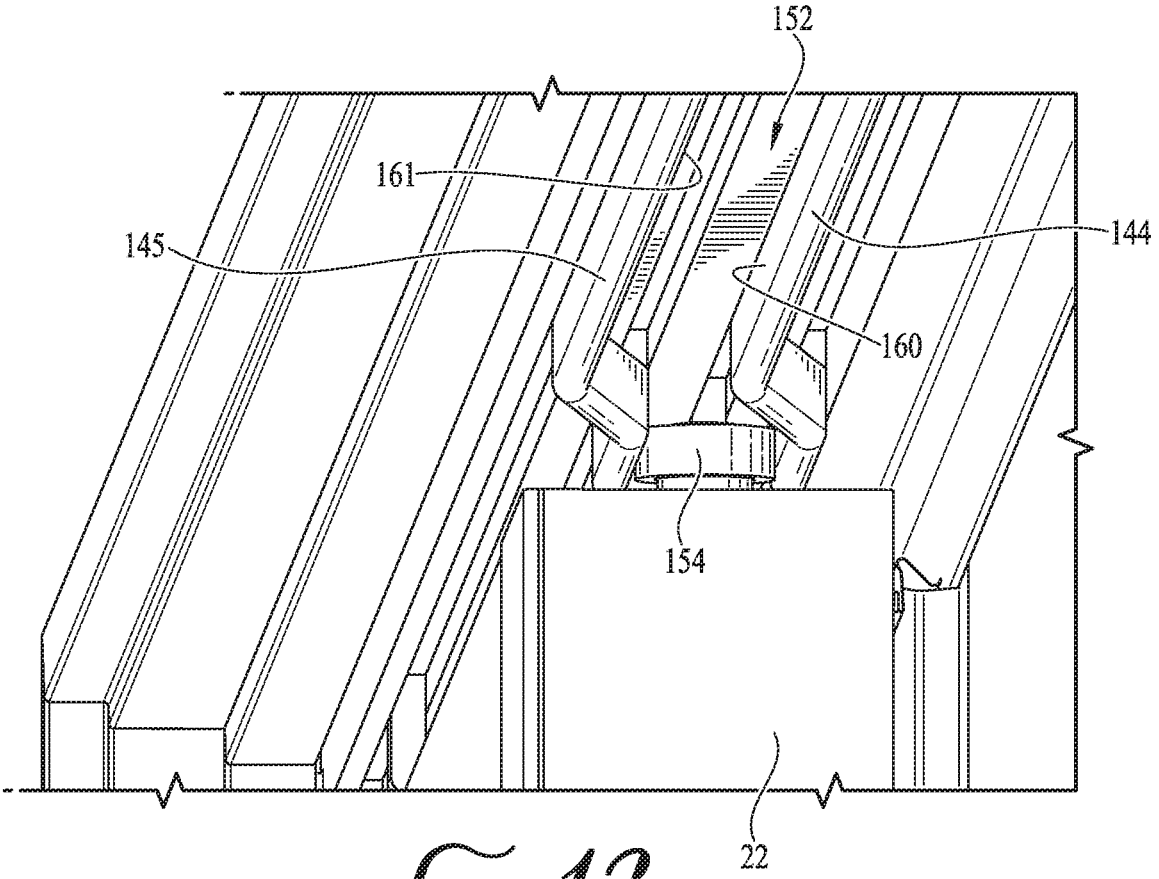
FIG. 12 illustrates a roller assembly for accommodating the sliding action of the sliding panel along the head portion.

With reference to FIG. 9, a first head track 144 is inserted into the track channels 134, 136, such that the first portion 146 of the head track 144 sits in the track channel 134 and the third portion 150 sits in the track channel 136, with the second portion 148 extending or spanning between the track channels 134, 136. A second head track 145 is inserted into the track channels 138, 140 in a similar arrangement as described with respect to the first head track 144. When the head tracks 144, 145 are coupled to their respective head track channels 134, 136, 138, 140, a guideway 152 is formed between the head tracks 144, 145, where the guideway 152 is designed to receive the head roller 154 (see FIG. 12). The head tracks 144, 145 each include an interior side surface 160, 161 facing one another and toward the guideway 152. In a completed assembly of the fenestration sliding system 10, the head roller 154 is positioned within the guideway 152 and moves between the head tracks 144, 145 as illustrated in FIG. 12. As the sliding panel 22 is moved, the head roller 154 rides against the interior side surfaces 160, 161 of the head tracks 144, 145 to accommodate movement of the sliding panel 22 and stabilize the panel 22 as the bottom rollers 26 ride along the sill tracks 54, 55. In some embodiments, the head tracks 144, 145 may be spaced apart such that the guideway 152 is wider than the corresponding width of the head roller 154. In such configuration, the head roller 154 may not contact both head tracks 144, 145 simultaneously during movement of the sliding panel 22. Such design may be advantageous to provide some tolerance for the head roller 154 within the head tracks 144, 145 and facilitate the sliding movement of the panel 22. In some cases, if the fit is too tight, it may be difficult to move or slide the head roller 154 smoothly, or it may lead to damage or wear of the head roller 154 and head tracks 144, 145.

Figure 13:
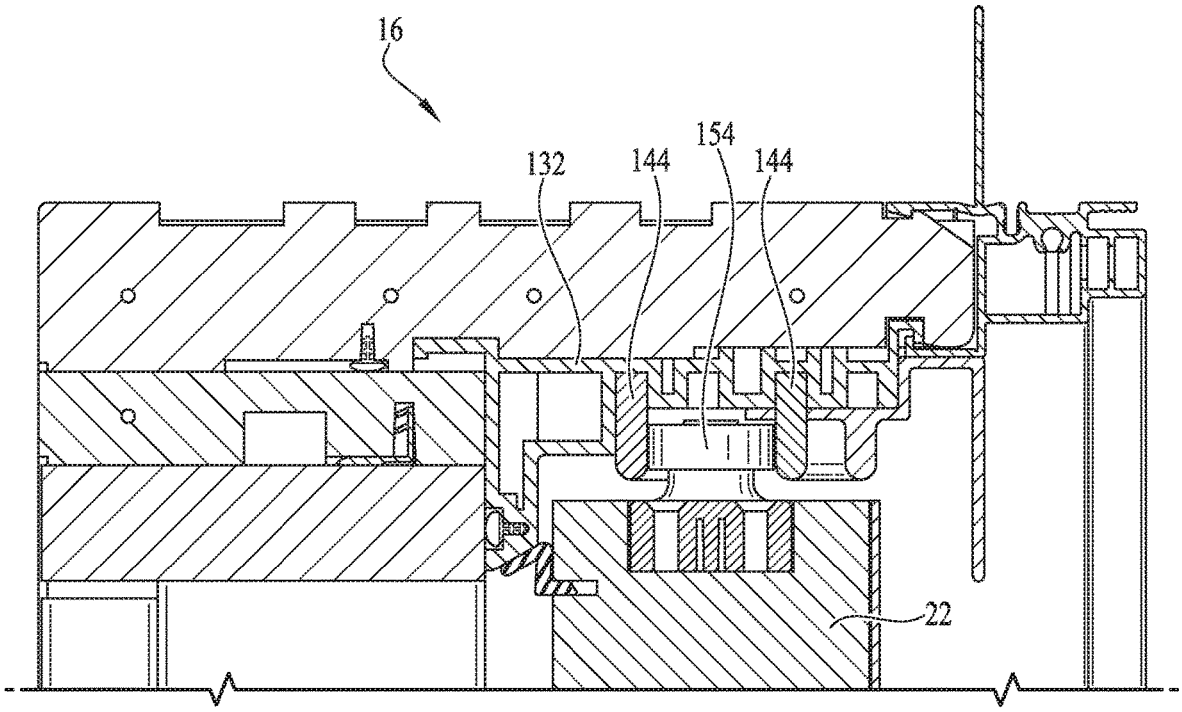
FIGS. 13 and 14 are each cross-sectional detail views illustrating the sliding fenestration system in a closed and opened position at the head portion, respectively, in accordance with one embodiment.
Figure 14:
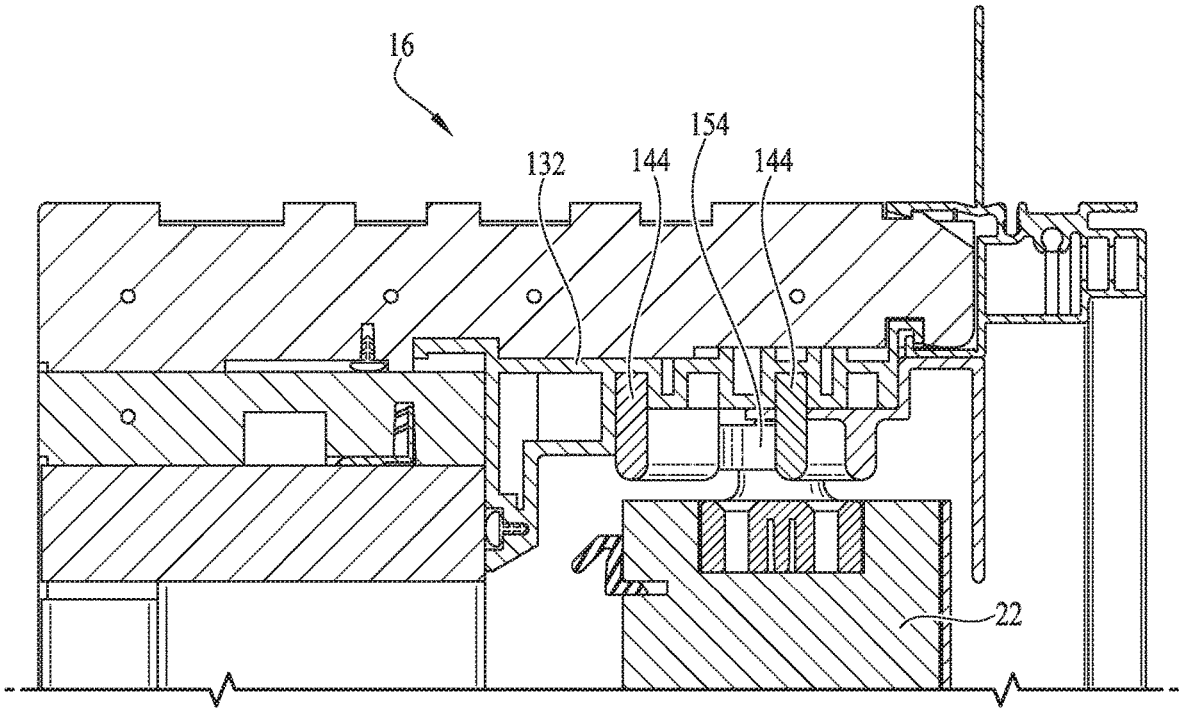

FIGS. 13 and 14 are each cross-section views of the head assembly 16 of section 13-13 (see FIG. 1) illustrating a position of the head roller 154 within the guideway 152 when the sliding panel 22 is in the closed position and the open positioned, respectively. With reference to FIG. 13, when the sliding panel 22 is in the closed position, the head roller 154 is seated between the first track segments 146 of the head tracks 144. Turning to FIG. 14, as the sliding panel 22 is opened, the head roller 154 moves along the guideway 152 and transitions from the first track segment 146 to the second track segment 148. As the sliding panel 22 is more fully opened, the head roller 154 transitions from the second track segment 148 to the third track segment 150 and moves along the length of the third track segment 150 while in the open position.

In another embodiment, the head assembly 16 may not include a head roller 154 but may instead include a pin (not shown) or other guide member positioned within the guideway 152 to ensure the sliding panel 22 is secured within the frame structure 12. In such embodiments, the guideway 152 may be formed directly on the head assembly 16 without need for head tracks 144, 145, and the guide member may travel within the guideway 152 in a similar fashion as described above.

For clarity, the bottom rollers 26, 112 and head rollers 154 are designed and arranged to move concurrently along their respective tracks as the sliding panel 22 is moved. Accordingly, when the bottom rollers 26, 112 transition from the first track segment 56 to the second track segment 58 of the sill track 54, the head rollers 154 are also transitioning in the same fashion within the guideway 152 to accommodate the biaxial movement of the sliding panel 22.

Figure 15:
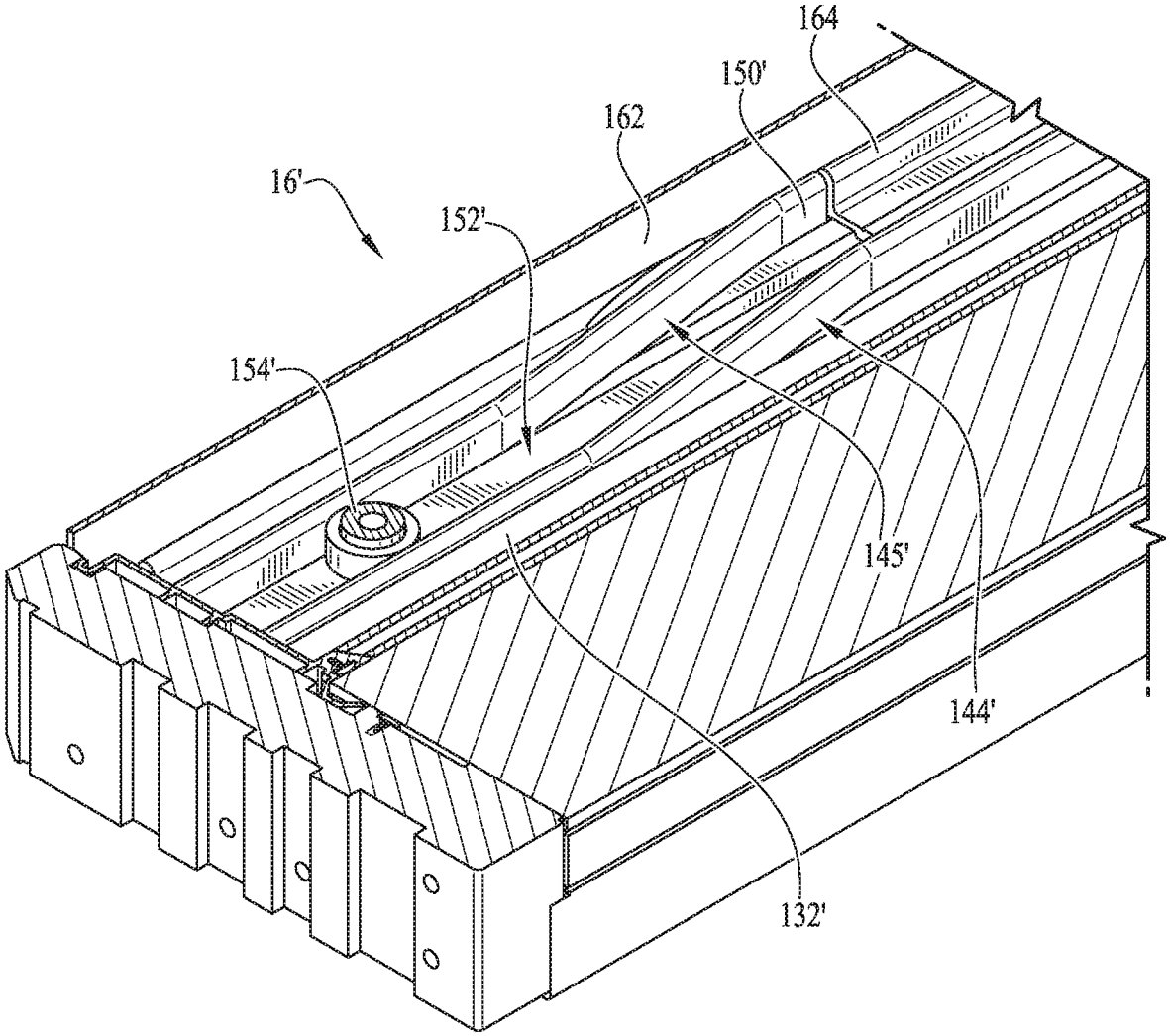
FIG. 15 illustrates details of the head assembly of the sliding fenestration system of FIG. 1 in accordance with another embodiment, where the head assembly includes a removable guide rail for facilitating an installation process of the sliding panel.

FIG. 15 illustrates details of another embodiment of a head assembly 16' in accordance with another embodiment. It is noted that many components of the head assembly 16' are substantially similar to corresponding components of the head assembly 16 described with reference to FIGS. 9-14.

Accordingly, the following description uses like prime numbers to reference components in FIG. 15 that include the same features and characteristics as the corresponding components described previously. Such components are not further described with reference to FIG. 15 to avoid repetition.

With reference to FIG. 15, the head assembly 16' includes a head 132' having a plurality of track channels (not shown), each channel extending horizontally along the head 132'. The channels include a corresponding head track 144', 145' seated therein and forming a guideway 152' therebetween, the guideway 152' receiving a head roller 154' for accommodating sliding movement of the sliding panel (not shown) as described previously. As illustrated in FIG. 15, one of the head tracks 145' includes a truncated or shortened third track segment 150' seated within one of the channels. To complete the track, the head assembly 16' includes a removable guide rail 162 including a track segment 164 having a matching profile (i.e., same height and overall shape) as the third track segment 150' of the head track 144'. When the removable guide rail 162 is installed in position on the head assembly 16' and secured thereto, the track segment 164 aligns with the truncated third track segment 150' to continue the track at a length matching that of the head track 144'. In this configuration, the track segment 162 and the head tracks 144', 145' cooperate to form the guideway 152' for the head roller 154' in a similar fashion as described previously with respect to the embodiment of FIGS. 9-14.

As mentioned above, the guide rail 162 is designed to be removable from the head assembly 16'. As further described below, designing the head assembly 16' with a removable guide rail 162 may facilitate the installation process of the sliding panel 22. The following describes a conventional installation processes for sliding panels 22 and follows with a brief description of the advantage of using a removable guide rail 162.

In some panel installation processes, the top of the sliding panel 22 is first lifted upwardly toward the head assembly 16 to provide enough clearance to tilt the bottom of sliding panel 22 toward the sill assembly 14 and lower the sliding panel 22 into position. Since the sliding doors 22 are typically heavy and large, this installation process can be relatively difficult. In contrast, having a head assembly 16' with a removable guide rail 162 as illustrated in FIG. 15 provides an opportunity to reverse the installation process. In such configuration, the guide rail 162 is first removed from the head assembly 16' to provide a clearance for the sliding panel 22 along the head of the fenestration frame. With the guide rail 162 removed, the bottom of the sliding panel 22 may first be positioned on the sill assembly 14 (i.e., the rollers 26 may be positioned on the tracks 54, 55), and then the sliding panel 22 may be tilted upwardly toward the head assembly 16' into position. With the removal of the guide rail 162 and since the head track 145' has a truncated third track segment 150', there is enough clearance to accommodate this process as noted above. Once the sliding panel 22 is in position, and the head roller 154' is in the guideway 152', the guide rail 162 is installed and fastened in position along the head assembly 16'. With the guide rail 162 installed, the track 145' now extends to a desired length to complete the guideway 152' as described with reference to FIG. 15.

In still another embodiment, the sill assembly 14 may include a track formed thereon that accomplishes a similar biaxial movement of the sliding panel 22 described previously without use of the modular tracks 54, 55. In such embodiments, a track like that created by the modular tracks 54, 55 and the track channels 46, 48 may be formed along the sill assembly 14. For example, in one embodiment, the sill 28 may include the track formed directly thereon within a channel of the sill 28. In such embodiments, the roller wheels 26, 112 may ride along the track within the channel to accomplish the biaxial movement described herein when the sliding panel 22 is operated.

It is intended that subject matter disclosed in various portions herein can be combined with the subject matter of one or more of other portions herein as long as such combinations are not mutually exclusive or inoperable. In addition, many variations, enhancements and modifications of the lighted shelf assembly concepts described herein are possible.

The terms and descriptions used above are set forth by way of illustration only and are not meant as limitations. Those skilled in the art will recognize that many variations can be made to the details of the above-described embodiments without departing from the underlying principles of the invention.

I claim:

1. A fenestration system comprising:

a sill having a first track channel and a second track channel formed thereon, the track channels offset from one another;

a sill track including a first track segment extending along a first axis, a second track segment extending along a second axis, and a third track segment extending along a third axis offset from the first axis, the second track segment extending between the first and third track segments, wherein the first track segment is secured within the first track channel and the third track segment is secured within the second track channel of the sill, the second track segment extending between the first and second track channels; and a sliding panel including at least one bottom guide assembly coupled thereto and moveable with the sliding panel, the bottom guide assembly including a roller configured to roll along the sill track along the first axis, second axis, and third axis, the roller being moveably attached to the sliding panel to advance along a fourth axis relative to the sliding panel as the roller moves between the first, second, and third track segments of the sill track to accommodate movement of the sliding panel, the fourth axis being normal to the first axis, second axis, and third axis, wherein the sliding panel moves in a first direction of motion along the first axis when the bottom guide assembly moves along the first track segment, and moves in a second direction of motion different from the first direction of motion along the second axis when the bottom guide assembly moves along the second track segment.

2. The sliding fenestration system of claim 1, wherein the sliding panel moves in a third direction of motion different from the second direction of motion along the third axis when the bottom guide assembly moves along the third track segment.

3. The sliding fenestration system of claim 1, wherein the first and second track channels on the sill are parallel to one another, each extending horizontally across the sill, and wherein the first and third track segments of the sill track are parallel to one another.

4. The sliding fenestration system of claim 1, the sill further including a region separating the first and second track channels from one another, the region including a wall, and wherein the second track segment includes an opening that receives the wall of the region.

5. The sliding fenestration system of claim 1, further comprising:

a second sill track including a first track segment extending along a first axis, a second track segment extending along a second axis, and a third track segment extending along a third axis offset from the first axis, the second track segment extending between the first and third track segments, the second sill track offset from the first sill track, wherein the first track segment is secured within the first track channel and the third track segment is secured within the second track channel of the sill, the second track segment extending between the first and second track channels, and wherein the sliding panel includes a second bottom guide assembly coupled thereto and moveable with the sliding panel, the second bottom guide assembly engaging the second sill track and operable to move along the first, second, and third track segments of the second sill track to accommodate movement of the sliding panel.

6. The sliding fenestration system of claim 1, wherein the sliding fenestration system further includes a frame assembly, the frame assembly including a seal interface, and wherein the sliding panel further includes a seal coupled thereto, the seal contacting the seal interface of the frame assembly when the bottom guide assembly is positioned along the first track segment, and wherein the seal is offset from the seal interface when the bottom guide assembly is positioned along either the second track segment or the third track segment.

7. The sliding fenestration system of claim 1, wherein the sill further includes a seal coupled thereto, and wherein the sliding panel contacts the seal when the bottom guide assembly is positioned along the first track segment, and wherein the sliding panel is offset from the seal when the bottom guide assembly is positioned along either the second track segment or the third track segment.

8. The sliding fenestration system of claim 1, wherein when the sliding panel is in a closed position, the bottom guide assembly is positioned along the first track segment, and wherein when the sliding panel is in an open position, the bottom guide assembly is positioned along either the second track segment or the third track segment.

9. The sliding fenestration system of claim 1, wherein the bottom guide assembly includes a threaded roller support that supports the roller and a base that is fixed to the sliding panel and having a threaded interior portion, the threaded roller support mating with the threaded interior portion to accommodate rotation of the threaded roller support about the fourth axis and consequential movement of the roller along the fourth axis as the roller moves between the first, second, and third track segments.

10. The sliding fenestration system of claim 1, further comprising:

a head assembly including a guideway;

a guide member coupled to the sliding panel and moveable therewith, the guide member disposed within the guideway of the head assembly, wherein the guide member travels within the guideway as the bottom guide assembly rides along the sill track to accommodate movement of the sliding panel.

11. The sliding fenestration system of claim 10, the head assembly further comprising:

a first head track channel, a second head track channel, a third head track channel, and a fourth head track channel formed thereon, the head track channels each offset from one another;

a first head track including a first head track segment, a second head track segment, and a third head track segment, the second head track segment extending between the first and third head track segments, wherein the first head track segment is positioned within the first head track channel, the third head track segment is positioned within the second head track channel, and the second head track segment extends between the first and second head track channels; and a second head track including a first head track segment, a second head track segment, and a third head track segment, the second head track segment extending between the first and third head track segments, wherein the first head track segment is positioned within the third head track channel, the third head track segment is positioned within the fourth head track channel, and the second head track segment extends between the third and fourth head track channels, wherein the guideway is formed between the first and second head tracks.

12. The sliding fenestration system of claim 10, further comprising a guide rail removably coupled to the head assembly, the guide rail including a guide track segment having a profile matching that of the third head track segment of the second head track, wherein the guide track segment aligns with the third head track segment of the second head track to form the guideway when the guide rail is coupled to the head assembly.

13. The sliding fenestration system of claim 1, wherein the sill track is elongate with the second track segment connecting the first track segment and the third track segment on opposite ends thereof, the first track segment inserted and partly protruding from the first track channel for supporting the roller, the third track segment inserted and partly protruding from the second track channel for supporting the roller.

14. A sliding fenestration system comprising:

a sill including a track having a first track segment aligned with a first plane, a second track segment aligned with a second plane, and a third track segment aligned with a third plane offset from the first plane, the second track segment extending between the first and third track segments; and a sliding panel including at least one bottom guide assembly coupled thereto and moveable with the sliding panel, the bottom guide assembly including a roller configured to roll along the first, second, and third track segments, the roller being moveably attached to the sliding panel to advance along an axis relative to the sliding panel as the roller moves between the first, second, and third track segments to accommodate movement of the sliding panel, the axis being parallel to the first plane, the second plane, and the third plane, wherein the sliding panel moves in a first direction of motion aligned with the first plane when the bottom guide assembly moves along the first track segment, and wherein the sliding panel moves in a second direction of motion outside the first plane when the bottom guide assembly moves along the second track segment.

15. The sliding fenestration system of claim 14, wherein the first track segment and the third track segment are parallel to one another.

16. The sliding fenestration system of claim 15, wherein the second track segment is arranged at an angle relative to the first and third track segments.

17. The sliding fenestration system of claim 14, further comprising:

a second track including a first track segment, a second track segment, and a third track segment, the second track segment extending between the first and third track segments, the second track offset from the first track, wherein the sliding panel includes a second bottom guide assembly coupled thereto and moveable with the sliding panel, the second bottom guide assembly engaging the second track and operable to move along the first, second, and third track segments of the second track to accommodate movement of the sliding panel.

18. The sliding fenestration system of claim 14, wherein one of the sill and the sliding door includes a seal, and the other of the sill and the sliding door includes a seal interface, and wherein the seal and seal interface contact one another when the bottom guide assembly is aligned with the first plane, and wherein the seal and seal interface are offset from one another when the bottom guide assembly is positioned outside the first plane.

19. The sliding fenestration system of claim 14, wherein when the sliding panel is in a closed position, the bottom guide assembly is positioned along the first track segment, and wherein when the sliding panel is in an open position, the bottom guide assembly is positioned along either the second track segment or the third track segment.

20. The sliding fenestration system of claim 14, wherein the bottom guide assembly includes a wheel assembly comprising:

a base mountable to the sliding panel and having a threaded interior portion;

a threaded roller support that is threaded to the threaded interior portion of the base, the threaded roller support including a first leg and a second leg offset from one another and forming a slot therebetween;

the roller disposed in the slot between the first and second legs; and an axle extending between the roller and coupled to the first and second legs, the axle extending along an axle axis, wherein the roller is rotatably mounted to the axle for rotation about the axle axis.

* * * * *